United States Patent [19]

Oeggerli

[11] Patent Number: 4,882,015

[45] Date of Patent: Nov. 21, 1989

[54] METHOD FOR MANUFACTURING A PERFORATED BODY, FRICTION SPINNING MEANS USING THE PERFORATED BODY AND A FRICTION SPINNING DEVICE USING THE FRICTION SPINNING MEANS

[75] Inventor: Werner Oeggerli, Winterthur, Switzerland

[73] Assignee: Rieter Machine Works Ltd., Winterthur, Switzerland

[21] Appl. No.: 117,841

[22] Filed: Nov. 9, 1987

[30] Foreign Application Priority Data

Nov. 13, 1986 [CH] Switzerland ..... 4543/86

[51] Int. Cl.[4] ..... C25D 1/08

[52] U.S. Cl. ..... 204/11; 204/24

[58] Field of Search ..... 204/11, 24

[56] References Cited

U.S. PATENT DOCUMENTS 3,167,489 1/1965 Hadjian ..... 204/11
3,332,858 7/1967 Bittinger ..... 204/11

FOREIGN PATENT DOCUMENTS 2819339 11/1979 Fed. Rep. of Germany .
2074201 10/1981 United Kingdom .

OTHER PUBLICATIONS

"Metalloberfläche", 19th publication year, vol. 12, Dec. 1965, pp. 369 to 372, Munich, West Germany, Article of H. J. Heinrich entitled Galvanoplastische Siebherstellung.

"Metalloberfläche", 20th publication year, vol. 8, Aug. 1966, pp. 333 to 336, Article of H. J. Heinrich, entitled Verfahren zur Beeinflussung der Lochprofile bei der Galvanoplastischen Siebherstellung.

*Primary Examiner*—T. M. Tufariello
*Attorney, Agent, or Firm*—Werner W. Kleeman

[57] ABSTRACT

Friction spinning elements, in the form of drums or discs comprising perforated friction spinning bodies are subject to the requirement that, on the one hand, the entry section of each hole should be as small as possible, in order to prevent penetration of fibers wherever possible. On the other hand, the form of each hole in the longitudinal direction, as viewed in the airflow direction, should be as favorable as possible aerodynamically so that a hole acting as a nozzle generates the lowest possible air resistance. Further, the form of the hole viewed along its length should be selected such that dirt and dust or other contaminants which may penetrate into the hole do not remain caught therein. It has been established that in galvanically formed perforated bodies there is a tendency for each hole to become larger in section with increasing wall thickness, thus giving each hole a diffusor-like longitudinal section as viewed in the airflow direction. This advantage can be exploited in the use of the perforated body in a friction spinning process by arranging the fiber receiving surface of the body to be fabricated against the mold during the galvanic forming step whereby the narrowest section of the hole forms an opening edge at the fiber receiving surface.

14 Claims, 2 Drawing Sheets

METHOD FOR MANUFACTURING A PERFORATED BODY, FRICTION SPINNING MEANS USING THE PERFORATED BODY AND A FRICTION SPINNING DEVICE USING THE FRICTION SPINNING MEANS

CROSS REFERENCE TO RELATED APPLICATIONS

This application is related to the commonly assigned, copending U.S. patent application Ser. No. 07/119,496, filed Nov. 12, 1987, and entitled "FRICTION SPINNING DRUM" and also the commonly assigned, copending U.S. patent application Ser. No. 07/119,497, filed Nov. 12, 1987, and entitled "OPEN END FRICTION SPINNING DEVICE FOR PRODUCTION OF A YARN OR THE LIKE AND METHOD FOR PRODUCTION OF FRICTION SPINNING MEANS", the disclosures of which are incorporated herein by reference.

BACKGROUND OF THE INVENTION

The present invention relates to a new and improved method for producing a perforated body for receiving textile fibers or fibrous material deposited on a fiber receiving surface of the perforated body by means of an airstream. The perforated body is advantageously used in a friction spinning means or element which, in turn, is used in a friction spinning device.

Friction spinning means or elements as described are used in a known friction spinning method or process in which usually the friction spinning means or elements comprise two cylindrical spinning drums arranged next to each other and rotating in the same direction. At least one of the two drums is a so-called perforated drum.

An example of the previously mentioned friction spinning method and a spinning device in which a friction spinning drum is used has been disclosed in the commonly assigned European Published patent application No. 175,862. From that published patent application it is also apparent that the friction spinning means does not have to be in the form of a perforated drum; it could also, for instance, comprise a perforated disc combined with a conical roller.

Friction spinning devices using perforated drums or discs are known and are therefore not further described in this disclosure.

The purpose of the friction spinning device is to take up fibers fed to a fiber receiving surface of the perforated drum or disc in known manner by means of an air stream and to twist the fibers into a yarn or the like in the region of the convergent parts or zone of the two friction spinning drums or of a friction spinning disc and conical roller. The yarn is withdrawn in a direction extending substantially at right angles to the direction of rotation of the friction spinning drums.

Two perforated drums, as disclosed in the German Pat. No. 2,449,583, or one imperforate drum and one perforated drum, or an imperforate conical roller and a perforated disc, as disclosed in the aforementioned European Published patent application No. 175,862, can be used as friction spinning means or elements.

The airstream required for transporting the fibers is drawn by suction through the holes or perforations of the means of a suction nozzle located in the interior of the friction spinning drum or below the friction spinning disc. It is therefore clear that, on the one hand, the holes or perforations of this friction spinning means must have a cross-section or cross-sectional area in the narrowest section or region of each of the holes or perforations which, on the one hand, is so small that it substantially prevents take-up of too many fibers by these holes or perforations during deposition on the fiber receiving surface of the friction spinning means; such fibers may be either sucked away and lost, or at least cut on an edge of the mouth of the suction nozzle and thereby shortened.

On the other hand, the energy consumption of equipment of this kind should be held as low as possible, the quantity of air required making up a substantial part of the energy consumption. Furthermore, efforts should be made to oppose the tendency towards blockage of the holes or perforations. In friction spinning means of this kind, it is therefore desirable to select the hole or perforation section at the narrowest region or throat to be as large as possible from this viewpoint.

However, these requirements placed on the hole or 1 perforation diameter stand in direct opposition to each other.

From practical operation and from patent publications, for example, the German Published patent application No. 3,114,093, it is known that these holes or perforations, when formed with a circular cross-section or cross-sectional configuration, generally have a diameter between 0.5 and 0.8 mm.

On the other hand, the perforated drums must have inherent stiffness or rigidity so that no deformation arises in use. This calls for a minimum wall thickness of at least 1 mm when brass is used with, for example, a drum diameter of 50 mm.

It is, however, apparent that boring of such small holes or perforations, where the number of holes or perforations is in the region of several tens of thousands of holes or perforations per drum, in a material of 1.0 to 1.5 mm or greater thickness, cannot be carried out without problems and is therefore expensive.

If additional demands are placed upon the form or configuration of the holes or perforations, as in the case of German Published Pat. No. 2,919,316, then the manufacturer of such perforated drums is faced with special problems.

SUMMARY OF THE INVENTION

Therefore, it is a primary object of the present invention to provide a new and improved method for manufacturing a perforated body which is not afflicted with the aforementioned drawbacks and shortcomings of the prior art.

In keeping with the preceding object it is a further significant object of the present invention to provide a friction spinning means using the thus manufactured perforated body and a friction spinning device using such friction spinning means.

Another significant object of the present invention is to provide a perforated body for a perforated drum or disc used in a friction spinning means, which perforated body has adequate inherent stiffness or rigidity and can be manufactured such that, on the one hand, the hole section of a hole or perforation at its narrowest location or position is small enough to prevent or at least minimize undesirable passage of fibers therethrough as far as possible, while, on the other hand, the hole or perforation has a form which counteracts blockage of the holes or perforations and presents the smallest possible airflow resistance to the airstream.

Now in order to implement these and still further objects of the invention, which will become more readily apparent as the description proceeds, the method for the manufacture or production of a perforated body contemplates that the perforated body is manufactured by means of a galvanic forming (electroforming) process employing a mold (former). The perforated body is fabricated such that the fiber receiving surface is directed towards the mold.

An important advantage of this method is that the mold can be made by a mechanical, photochemical and/or etching process, i.e. that the holes or perforations of the mold, which are filled with a non-conducting material, do not need to go right through or constitute throughpass holes or perforations in order to nonetheless create a hole or perforation in the perforated body.

A further advantage of the galvanically formed perforated body is that in use of the process step in which the fiber receiving surface engages the mold the hole or perforation is not cylindrical but, as viewed from the mold, exhibits a continuous widening or enlargement. This constitutes a notable advantage from the point of view of airflow and of blockage when the airstream from the fiber receiving surface enters the narrowest hole or perforation section or region.

It is a further advantage of this method that the holes or perforations of the perforated body do not have to be circular or possess a circular cross-sectional configuration, but can have any other form or configuration because they can be made not only by boring but also, as mentioned, with the aid of a mold produced photochemically or by etching.

BRIEF DESCRIPTION OF THE DRAWINGS

The invention will be better understood and objects other than hose set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the mold structure or equivalent device for forming the perforated body, the friction spinning means or elements, and the friction spinning devices, have been illustrated therein as are needed to enable one skilled in the art to readily understand the underlying principles and concepts of this invention.

Figure 1:
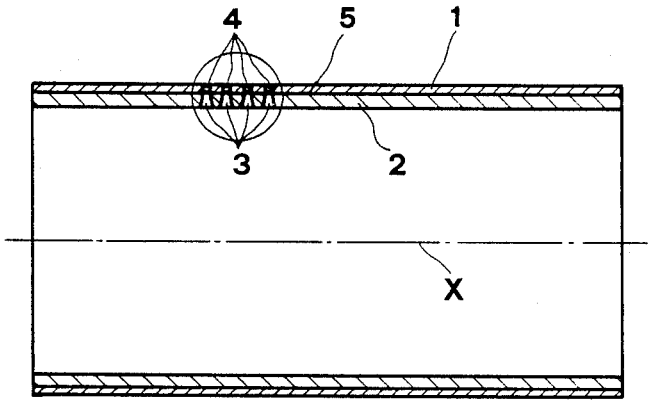
FIG. 1 shows a longitudinal section through a perforated body made by a technique according to the present invention, in which for simplicity only a detail including the holes or perforations is illustrated.

Turning now specifically to FIG. 1 there is shown therein a mold or former 1 in the form of a hollow drum for production of a hollow drum-shaped perforated body 2 by a conventional galvanic or electroforming technique. The mold or former 1 in conventional manner constitutes the cathode on which the ions build up the perforated body 2. The anode is not shown because it is not the subject of the invention, which does not relate to such known galvanic forming technology and anyway, such anode structure is well known in that technology. Furthermore, the manner in which the formed body is removed or stripped from the mold or former 1 is also not the subject of the invention, and therefore is not here further explained, particularly since conventional mold stripping techniques can be used. The invention is confined to the use of a perforated body formed by a galvanic technique as part of a friction spinning means or element.

The mold or former 1 has suitable electrical insulation 4 at each of those locations or positions at which a hole or perforation is to be made in the perforated body, so that no ions build up at those locations or positions to form part of the body. As is known, these electrical insulators 4 can be plastic fillings set into recesses or holes in the mold or former 1. It is also known to make these recesses or holes mechanically, photochemically and/or by etching.

Figure 2:
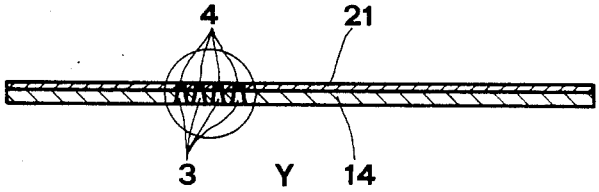
FIG. 2 shows a modification of the perforated body according to the invention, also for simplicity illustrated only in part including the holes or perforations.
Figure 3:
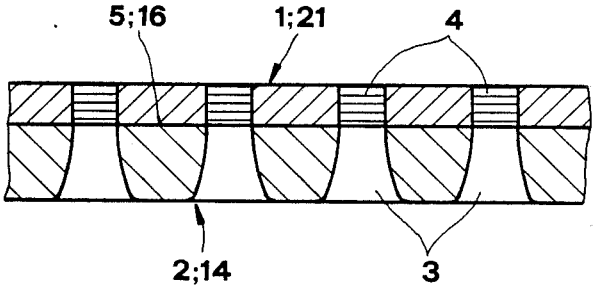
FIG. 3 depicts in an enlarged scale the sectional detail encircled by a circle in each of FIGS. 1 and 2 including the holes or perforations of such FIGS. 1 and 2.

As shown in FIG. 1 and to a larger scale in FIG. 3, the ions build up around the electrical insulators 4 in such manner that each hole or perforation 3 so produced becomes steadily larger with increasing ion build up. In section, a hole or perforation of this kind has a diffusor-like configuration or appearance viewed from the electrical insulator, as illustrated in FIGS. 1 to 4. This is advantageous as regards hole blockage and airflow therethrough.

These diffusor-shaped holes or perforations 3 are so arranged with respect to the perforated body 2 that the narrowest section or region of each of the holes or perforations 3 opens onto or at a fiber receiving surface, onto which, during use of the perforated body 2 in a friction spinning device, fibers are delivered in known manner by means of an airstream so as to be taken up by or deposited at such fiber receiving surface.

This airstream or airflow flows through the holes or perforations 3 after deposition of the fibers on the fiber receiving surface.

Figure 8:
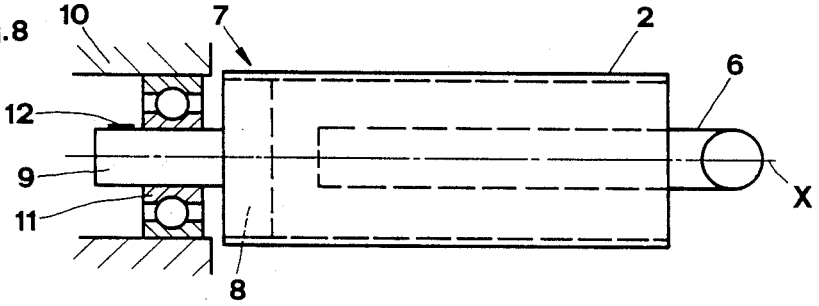
FIG. 8 shows a longitudinal view, partly in section, of a friction spinning drum with the perforated body of FIG. 1 and drawn to a smaller scale.

FIG. 8 also shows a friction spinning drum 7, designated broadly as a friction spinning means or element, in which the perforated body 2 is mounted on a support or support member 8 which, in turn, is appropriately supported for rotation about an axis X (see also FIG. 1) by means of a shaft 9 and a roller bearing 11 mounted thereon and carried in a bearing housing 10. The friction spinning drum 7 can be driven via the shaft 9 from, for instance, a drive belt 12.

The previously mentioned airstream or airflow is generated in known manner by a suction nozzle 6 or equivalent structure leading into a chamber of the perforated friction spinning drum 7.

FIG. 8 is merely intended to show that the perforated body of FIG. 1 can be used as the drum of a drum-shaped friction spinning means in a friction spinning device.

As an alternative to the drum-like or drum-shaped perforated body 2, FIG. 2 shows a disc-shaped perforated body 14, together with a disc-shaped mold 21—each illustrated in section—by means of which the disc-shaped perforated body 14 is galvanically formed.

In a similar manner to FIG. 1, this FIG. 2 shows a detail within the depicted circular region and which is illustrated on a larger scale in FIG. 3; the diffusor-like holes or perforations 3 and the electrical insulators 4 are shown in those Figures.

Figure 9:
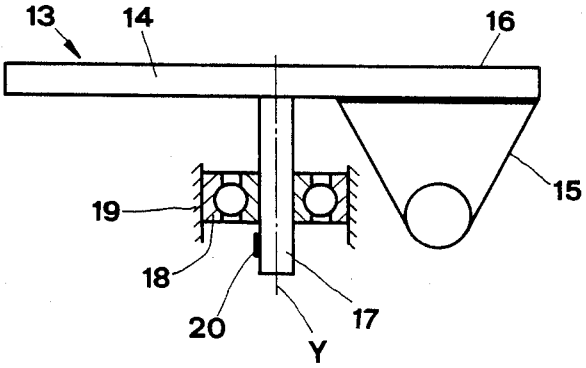
FIG. 9 shows a schematic view of a friction spinning disc with the perforated body of FIG. 2 and drawn to a smaller scale.

FIG. 9 shows a friction spinning disc 13, designated broadly as a friction spinning means or element, in which the perforated body 14 is used. The upper surface of the friction spinning disc 13, as viewed in FIG. 9, has a fiber receiving surface 16 onto which the holes or perforations 3 open at their narrowest section or region. The airstream passing through the holes or perforations 3 from the fiber receiving surface 16 is generated by a suction nozzle 15 provided on the underside of the friction spinning disc 13 as viewed in FIG. 9.

The perforated body 14 is appropriately rotatably supported on a rotational axis Y (see also FIG. 2) by means of a shaft 17 secured thereto and received in a roller bearing 18. The roller bearing 18, in turn, is received in a bearing housing 19. The drive to the shaft 17 is transmitted, for instance, via a drive belt 20.

Figure 4:
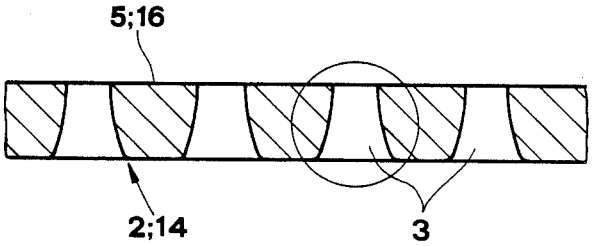
FIG. 4 illustrates by itself the body part of the detail taken from FIG. 3.

In FIG. 4, the perforated body 2 or 14 of FIG. 3 is individually shown. This illustration is intended to demonstrate that a sharp, but burr-free edge is formed at the narrowest section or region of the holes or perforations 3. These holes or perforations 3 open at this narrowest section or region onto the fiber receiving surface 5 or 16.

Figure 5:
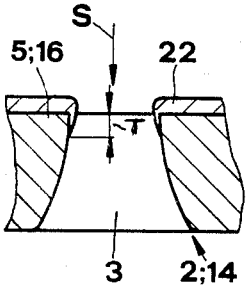
FIG. 5 shows a detail representing a hole or perforation from the arrangement of FIG. 4, depicted on a larger scale, and additionally illustrated to be provided with a coating or layer.
Figure 6:
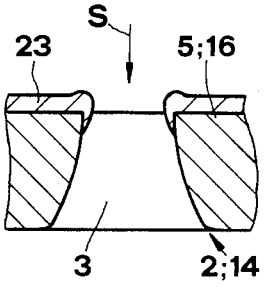
FIG. 6 shows the detail of FIG. 5 with a modification of the coating or layer.
Figure 7:
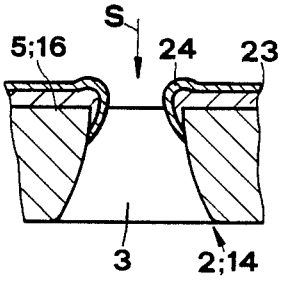
FIG. 7 shows the detail of FIG. 6 provided with an additional coating or layer.

FIGS. 5, 6 and 7 each show the same detail taken from FIG. 4 and representing a single hole or perforation 3 of the perforated body 2 or 14. It will be apparent that the perforated body 2 or 14 can be coated as required on the fiber receiving surface 5 or 16 which also, if desired, can be appropriately roughened.

FIG. 5 shows, for example, a plasma coating or layer 22 which projects a certain distance T into the hole or perforation 3 as viewed in the direction of airflow S. In this way, the inherently sharp edge of the narrowest section or region is somewhat rounded. The plasma coating or layer 22 serves to provide the fiber receiving surface 5 or 16 with a rough but wear resistant layer. The distance T is not essential in itself. On the other hand, in dimensioning the narrowest section or region of the uncoated fiber receiving surface 5 or 16, the constriction or narrowing caused by the coating should be taken into account.

FIG. 6 shows a galvanic coating or layer 23 on the fiber receiving surface 5 or 16. For physical reasons, this galvanic coating 23 builds up a kind of ridge around the sharp edge of the narrowest section or region of the hole or perforation 3, thereby narrowing or constricting such narrowest section or region to a still greater extent than occurs with the plasma layer or coating. This method can be used either when the hole or perforation 3 should exhibit after the narrowest section or region a short but more sudden expansion or enlargement, as viewed in the direction of the airflow S, than is achieved by the galvanic forming method, the section or region then merging into the normal widening or enlargement of the galvanically formed hole or perforation 3, or when the galvanically formed narrowest section or region is to be made still narrower.

FIG. 7 shows that an additional plasma layer or coating 24 can be deposited on the galvanic coating or layer 23 illustrated in FIG. 6 if a degree of roughness of the outermost layer is required.

The fiber receiving surface may be an external surface or an internal surface of the perforated body.

Finally, it is mentioned that each hole of the perforated body has a surface or cross-sectional area of at least 0.07 $mm^2$ at the narrowest section or region thereof.

It is clear that the present invention is not limited to the manufacture of substantially cylindrical perforated bodies. Basically, any form is possible provided it permits separation from the mold.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A method for the production of a perforated body for receiving textile fibers deposited on a fiber receiving surface of the perforated body by means of an airstream and containing perforations through which the airstream is passed and which widen in the direction of flow of the airstream, comprising the steps of:

providing a mold for the formation of the perforated body and containing inset electrical insulator fillings in holes at a predetermined number of locations corresponding to the locations of the perforations in the perforated body to be formed; and electroforming on the mold of a perforated body containing perforations which widen in the direction of flow of the airstream.

2. The method as defined in claim 1, wherein:

said step of electroforming the perforated body entails forming a fiber receiving surface on a predetermined surface of the perforated body which is directed towards the mold; and during said step of electroforming said perforated body, forming in said perforated body perforations which exhibit a continuous enlargement from said fiber receiving surface as viewed in the direction of flow of the airstream through the perforations of the perforated body.

3. The method as defined in claim 2, further including the step of:

adhering at least one layer to the fiber receiving surface of the perforated body.

4. The method as defined in claim 3, further including the steps of:

providing the fiber receiving surface with a galvanic coating extending at least partially into the individual holes.

5. The method as defined in claim 4, further including the step of:

roughening the fiber receiving surface.

6. The method as defined in claim 5, further including the step of:

depositing a layer in order to roughen the fiber receiving surface.

7. The method as defined in claim 6, wherein:

said deposited layer is a plasma layer.

8. The method as defined in claim 2, further including the step of:

roughening the fiber receiving surface.

9. The method as defined in claim 3, further including the steps of:

initially providing the fiber receiving surface with a galvanic coating extending at least partially into the individual holes defining the perforations; and additionally providing the fiber receiving surface with a plasma layer deposited on the galvanic coating.

10. A method for the production of a perforated body for receiving textile fibers deposited on a fiber receiving surface of the perforated body by means of an airstream and for passage of the airstream through perforations of the perforated body, comprising the steps of:

providing a mold for the formation of the perforated body;

forming by galvanic electroforming by means of the mold a perforated body;

manufacturing the perforated body such that a predetermined surface of the perforated body intended to constitute the fiber receiving surface of the perforated body is directed towards the mold;

forming holes defining perforations of the perforated body such that said holes exhibit a continuous enlargement from said fiber receiving surface as viewed in an intended direction of flow of the airstream through the perforations of the perforated body;

adhering at least one layer to the fiber receiving surface of the perforated body;

providing the fiber receiving surface with a galvanic coating extending at least partially into the individual holes; and roughening the fiber receiving surface.

11. The method as defined in claim 10, further including the step of:

depositing a layer in order to roughen the fiber receiving surface.

12. The method as defined in claim 1, wherein:

said deposited layer is a plasma layer.

13. A method for the production of a perforated body for receiving textile fibers deposited on fiber receiving surface of the perforated body by means of an airstream and for passage of the airstream through perforations of the perforated body, comprising the steps of:

providing a mold for the formation of the perforated body;

forming by galvanic electroforming by means of the mold a perforated body;

manufacturing the perforated body such that a predetermined surface of the perforated body intended to constitute the fiber receiving surface of the perforated body is directed towards the mold;

forming holes defining perforations of the perforated body such that said holes exhibit a continuous enlargement from said fiber receiving surface as viewed in an intended direction of flow of the airstream through the perforations of the perforated body; and roughening the fiber receiving surface.

14. A method for the production of a perforated body for receiving textile fibers deposited on a fiber receiving surface of the perforated body by means of an airstream and for passage of the airstream through perforations of the perforated body, comprising the steps of:

providing a mold for the formation of the perforated body;

forming by galvanic electroforming by means of the mold a perforated body;

manufacturing the perforated body such that a predetermined surface of the perforated body intended to constitute the fiber receiving surface of the perforated body is directed towards the mold;

forming holes defining perforations of the perforated body such that said holes exhibit a continuous enlargement from said fiber receiving surface as viewed in an intended direction of flow of the airstream through the perforations of the perforated body;

adhering at least one layer to the fiber receiving surface of the perforated body;

initially providing the fiber receiving surface with a galvanic coating extending at least partially into the individual holes defining the perforations; and additionally providing the fiber receiving surface with a plasma layer deposited on the galvanic coating.

* * * * *

UNITED STATES PATENT AND TRADEMARK OFFICE

CERTIFICATE OF CORRECTION

PATENT NO. : 4,882,015

DATED : November 21, 1990

INVENTOR(S) : WERNER OEGGERLI

It is certified that error appears in the above-identified patent and that said Letters Patent is hereby corrected as shown below:

Column 1, line 65, after "the" (first occurrence) please insert --perforated friction spinning drum or friction spinning disc by--

Column 2, line 19, after ""or" please delete "1"

Signed and Sealed this

Twelfth Day of June, 1990

*Attest:*

HARRY F. MANBECK, JR.

*Attesting Officer*

*Commissioner of Patents and Trademarks*